United States Patent [19]

Laurent

[11] Patent Number: 4,536,424

[45] Date of Patent: Aug. 20, 1985

[54] GLAZING UNITS

[75] Inventor: Michel Laurent, Nivelles, Belgium

[73] Assignee: Glaverbel, Brussels, Belgium

[21] Appl. No.: 575,534

[22] Filed: Jan. 31, 1984

[30] Foreign Application Priority Data

Feb. 4, 1983 [GB] United Kingdom ..... 8303069

[51] Int. Cl.[3] ..... E06B 3/24

[52] U.S. Cl. ..... 428/34; 428/45; 428/192; 156/99; 156/107; 156/109; 52/171; 52/789

[58] Field of Search ..... 428/34, 46, 45, 192; 156/109, 99, 107; 52/222, 789, 171

[56] References Cited

U.S. PATENT DOCUMENTS

| | | | |
|---|---|---|---|
| 3,837,129 | 9/1974 | Losell | 52/789 |
| 4,149,348 | 4/1979 | Pyzewski | 428/34 |
| 4,335,166 | 6/1982 | Lizardo et al. | 428/34 |

FOREIGN PATENT DOCUMENTS

| | | | |
|---|---|---|---|
| 0034813 | 9/1981 | European Pat. Off. | 428/34 |
| 949147 | 2/1964 | United Kingdom | 428/34 |
| 1471660 | 4/1977 | United Kingdom | 428/34 |
| 1585823 | 5/1978 | United Kingdom | 428/34 |
| 2011985 | 7/1979 | United Kingdom | 428/34 |
| 2031982 | 4/1980 | United Kingdom | 428/34 |
| 2065756 | 7/1981 | United Kingdom | 428/34 |

*Primary Examiner*—Joseph L. Schofer
*Assistant Examiner*—Fred M. Teskin
*Attorney, Agent, or Firm*—Spencer & Frank

[57] ABSTRACT

A hollow glazing unit comprising vitreous sheets and a plastic foil wherein said vitreous sheets are held in spaced relationship by marginal spacing means which comprise one or more metal strips forming a spacing web located outward of the plastic foil, the metal strips being connected to the vitreous sheets by solder joints, wherein a plastic foil is held taut between and in spaced relationship to the vitreous sheets by means comprising components distinct from the spacing strip.

13 Claims, 2 Drawing Figures

GLAZING UNITS

BACKGROUND OF THE INVENTION

This invention relates to hollow glazing units comprising vitreous sheets held in spaced facing relationship by marginal connecting means.

Such units have insulating properties. They are extensively used in walls of buildings for thermal insulation purposes. And, depending on their composition, they can be effective for screening off radiation in certain parts of the electromagnetic spectrum.

It is well known that insulating effects of one kind or another can be increased by increasing the number of spaced skins or panes of such a unit. And in the building industry there has for many years been a marked interest in the use of hollow glazing units comprising three or more spaced panes or lights.

In comparison with a double window having two vitreous sheets, a multiple glazing unit comprising three vitreous sheets is thick, and of course it is significantly heavier. The greater weight implies the need for a heavier frame in which to mount the unit. In many circumstances these factors preclude the installation of those more complex units.

Multiple glazing units have been proposed in which two vitreous sheets are glued in spaced relationship to marginal spacing means which also serves as a frame for holding a plastics sheet or foil stretched between those vitreous sheets. By dividing the space between the outer vitreous sheets, the foil reduces convection currents and improves the thermal insulating effect of the unit. Moreover such a foil can usefully modify the radiant energy transmitting characteristics of the unit. For the latter purpose a coloured or tinted foil or a foil having a coating which is coloured or has good heat-reflecting properties can be used.

It is necessary for the foil to retain its truly planar wrinkle-free condition during the useful life of the glazing unit. Otherwise the foil will cause optical distortion. It is therefore important that during use of the glazing unit the support to which the margin of the foil is attached is not itself forced to undergo movements, e.g. as a result of mechanical forces on the unit or thermal gradients, such as to allow sagging or to cause deformation of the foil. On the other hand the marginal coupling of the vitreous sheets must be capable of absorbing such imposed forces without rupture or weakening of the joints between the vitreous sheets and the marginal spacing means.

In the previously proposed constructions of hollow glazing unit incorporating a stretched foil, the vitreous sheets are glued to spacer means which is wide enough to hold an adequate margin of the foil and provides a substantially rigid joint between the vitreous sheets. In general times, the spacers of the said units comprise separate or joined opposed portions forming a kind of jaw in which a margin of the foil is secured. In some units the foil margin is glued into the jaw (cf United Kingdom patent specification GB No. 2 065 756A and European Patent Application No. 0 034 813 Al). In others the spacer portions have mechanical fastening means by which they can be clamped onto the foil margin (cf FIG. 1 of United Kingdom patent specification GB No. 2 011 985 A).

SUMMARY OF THE INVENTION

It is an object of the present invention to provide a glazing unit which incorporates a stretched plastics foil and an efficient vitreous sheet coupling allowing relative movement of such sheets responsive to pressure or temperature variations across the unit.

According to the present invention there is provided a hollow glazing unit comprising vitreous sheets held in spaced relationship by marginal spacing means, characterised in that a plastics foil is held taut between and in spaced relationship to said vitreous sheets by foil holding means, and said spacing means comprises one or more metal strips forming a spacing web which is located outwardly of the periphery of said foil, said metal strip(s) being connected to the vitreous sheets by solder joints.

There may be a single said metal strip which is of such length and is so bent as to follow a path along the entire marginal zone of the unit, the ends of such strip being if desired joined to form a continuous spacer frame. Alternatively there may be a plurality of said metal strips extending along different parts of the marginal zone of the unit. For example in a rectangular glazing unit there may be four spacer strips, one for each straight margin of the unit and such four spacer strips can be joined end to end to form a continuous spacer frame if so desired.

For convenience reference will hereafter be made to "the spacer strip" as if there were only one such strip but except where the context requires otherwise it should be understood that two or more shorter spacer strips could be used instead of the one.

DETAILED DESCRIPTION OF THE EMBODIMENTS

Figure 1:
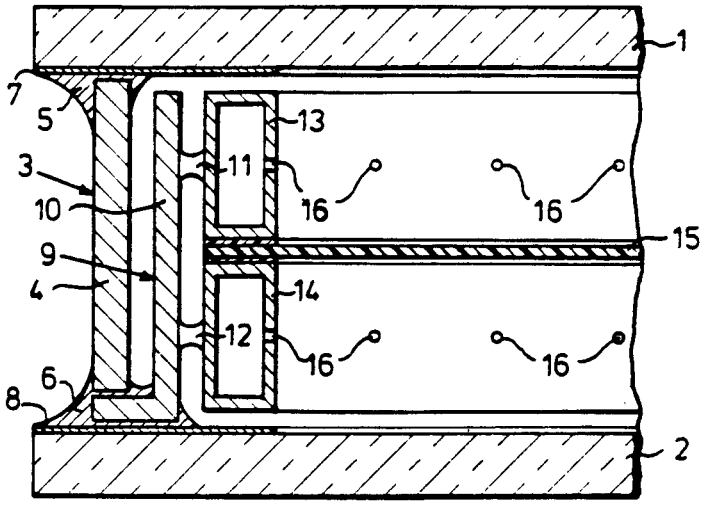
FIG. 1 is a cutaway edge view of an embodiment of the invention showing the plastic foil frame fixed to L-shaped components which are soldered to metallized coatings at the edges of the glass sheets of the glazing units along with the spacer strip.

The invention affords a number of advantages. Among these is the fact that the joint between the vitreous sheets is not split so as to accommodate the margin of the plastics foil. There is more freedom to form the spacing means to suit its specific function of coupling the vitreous sheets. Units according to the invention are in this respect in marked contrast to the previously proposed units in which bonding of the vitreous sheets to each other and the bonding or clamping of the foil in the unit are interdependent.

The soldering of vitreous sheets to a strip metal spacer in the manufacture of hollow glazing units is known per se (see e.g. United Kingdom patent specification Nos. 949 147, 1 471 660 and 1 585 823). It is a specific advantage of soldered units wherein the vitreous sheets are coupled by a metal strip which forms a spacing web extending between the normal to the sheets, with or without integral flanges along the longitudinal edges of such web, the relative movements of the vitreous sheets can take place, e.g. responsive to temperature or pressure gradients across the unit, without fracture of the solder joints. In a unit according to the present invention, this advantage is achieved notwithstanding the incorporation of a plastics foil into the unit, and at least some degree of relative movement between the sheets is possible without objectionable foil movement, causing optical distortion.

The use of solder joints for the vitreous sheets also affords potential advantages if the plastics foil is to be heat-shrunk in situ, as it may be, in the fabrication of the unit. Depending on the composition and thickness of the foil, such heat-shrinking may necessitate subjecting the foil to heating conditions which would be injurious to certain adhesives if they were used for holding the vitreous sheets. Solder joints are however resistant to any heating conditions likely to be required for heat-shrinking the foil. Such heat-shrinking can for example take place after the vitreous sheets have been mounted, by placing the complete assembly in an oven at a predetermined temperature for a predetermined time. Heat-shrinking is not necessary in all cases. In some circumstances the foil can be mounted in stretched condition as hereinafter exemplified.

A unit according to the invention can easily be made entirely resistant to ingress of moisture. For this purpose it is sufficient to form a continuous joint by means of the spacer strip. The problems which are encountered in preventing moisture penetration through glued joints are entirely avoided.

The invention can be employed for making units comprising plies additional to the said foil and the two vitreous sheets between which it is located. For example there may be more than one foil between such vitreous sheets, or there may be at least one further vitreous sheet held in spaced relationship to those two by one or more further spacer strips.

The spacer strip used in carrying out the invention can be of a metal element or a metal alloy and/or may comprise different metals coated one on another. For example, any of the materials used for forming metal spacer strips as used in commercially available soldered double glazing units can be used. The aforesaid United Kingdom patent specification No. 1 471 660 gives information concerning a variety of metal spacer materials and metal spacer properties and that information can be used in carrying out the present invention.

Known soldering practices can be followed in making units according to the present invention. After metallising the margins of the vitreous sheets where the solder joints are to be formed, the spacer strip can be soldered in position by solder beads applied in corner angles between such strip and the metallising coatings. Alternatively or in addition, layers of solder may be applied to the metallising coatings and/or to the spacer strip and melted in situ after the spacer strip has been properly located in relation to the vitreous sheets. Useful information concerning suitable soldering techniques is contained in United Kingdom patent specifications Nos. 949 147 and 2 031 982. The practice of melting preapplied solder layers in situ is more particularly useful when using a spacer strip having attachment flanges extending from the opposed longitudinal edges of the spacing web.

Advantageously, the foil holding means comprises one or more components which is or are distinct from the spacer strip(s) and the spacing web can be angularly deflected relative to such component(s).

As an alternative to the use of separately fabricated foil supporting component(s) as above referred to, the plastics foil can be connected directly to the inside of the spacing web. For example the metal spacing strip(s) can be provided with an integral flange projecting towards the interior of the unit from a central zone within the width of the spacing web. Such a construction still allows some relative angular deflection of the vitreous sheets at their marginally coupled zones without objectionable effect on the foil. However direct support of the foil by the metal spacing strip(s) is much less satisfactory than support of the foil by one or more separately fabricated supporting components as above referred to.

Preferably the foil is resiliently supported within the unit by one or more metal supporting components secured to one of the vitreous sheets. For example there can be a plurality of such supporting components distributed around the interior of the unit. This is a very satisfactory way of supporting the foil so that its truly planar stretched condition is not disturbed by deflections of the spacing strip. In preferred embodiments said foil-supporting component(s) and the spacing strip are soldered to one and the same metallising coating on the said one vitreous sheet.

The or each of said foil-supporting components is advantageously of an L-profile providing a base flange which is soldered to one vitreous sheet and a limb upstanding form that vitreous sheet, to which the foil is directly or indirectly connected.

If the foil is directly attached to said foil-supporting component(s) the latter is or are responsible for holding the foil taut. In a particular embodiment the margin of the foil is clipped to the foil-supporting component(s). Particularly when using this form of attachment, the foil-supporting component(s) preferably provides a continuous attachment limb to which the margin of the foil is connected. Such a continuous limb can be provided by using a single foil-supporting member in the form of a strip or ribbon which follows an endless course within the unit, or by mounting a plurality of foil-supporting members in end to end juxtaposition.

The foil can alternatively be glued to the foil-supporting component(s)

In certain very advantageous embodiments of the invention, the foil is held in stretched condition by a frame and this frame is connected to and resiliently supported in the unit by one or more foil-supporting components. Such component(s) may be of an L-profile and be mounted as above described. For those embodiments it is very suitable to provide a multiplicity of such supporting components distributed in spaced relationship around the periphery of the foil frame. The use of a framed foil makes assembly of the unit very straightforward because the framed foil can be easily handled. Preferably the foil frame is made of metal and is soldered to metal foil-supporting components. In a preferred construction the frame comprises a pair of component frames which are bonded together with a margin of the foil sandwiched between them.

When using a foil frame or frames as above referred to, the foil can be secured in or to the frame by adhesive.

When using an adhesive for securing the foil, use can be made for example of an adhesive which becomes set by undergoing polymerization, or it can be a solvent type adhesive which sets by evaporation of solvent. Preferably the foil adhesive is of the polymerising kind. Suitable adhesives are to be found among the epoxy resins and epoxy resin-based compositions. These adhesives include, for example, mixtures of epoxy resins of different molecular weights and mixtures of epoxy resins with one or more other polymer resins such as a polyamide resin. Such adhesives are very satisfactory for securing heat-shrinkable polyester film to metal components, e.g. components of galvanised steel. Prior to contact with the selected adhesive, the metal can be coated with an epoxy ester primer.

Other examples of suitable foil adhesives are polyester and polyurethane adhesives.

In preferred embodiments of the invention the or each metal spacer strip consists solely of a spacing web disposed normally to the vitreous sheets, the vitreous sheets being soldered to the longitudinal edges or margins of such web. Such a spacer member is of very simple form and it is very suitable for achieving a resilient coupling between the vitreous sheets such that it can absorb stresses without overstraining the solder joints.

In other advantageous embodiments of the invention the or each metal spacer strip is of channel form, the opposed sides of the channel are soldered to the vitreous sheets and the bottom wall of the channel forms said spacing web. The flanges provide attachment faces of significant area which can be bonded to the vitreous sheets by solder layers covering the same area. Very strong solder joints can therefore be formed.

If a heat-shrinkable foil is used, the foil may be in slack condition when initially clipped or glued to the foil-supporting component(s) and can be then heat-shrunk in situ.

The foil can be heat-shrunk in its frame before the frame has been mounted to supporting component(s) of the unit in course of its assembly. But it is preferable for such heat-shrinking to be effected after such mounting of the frame.

Plastics foils of various compositions can be used in carrying out the invention. Films formed wholly or mainly of a polyolefin such as polyethylene, or of a polyester, e.g. polyethylene terephthalate, are examples. Such foils can be heat-shrunk.

The plastics foil can be coated to confer particular properties on the foil. The foil may for example bear a metal or metal oxide coating with radiant heat-reflecting properties. Such coated foils and methods of making them are well known in the art.

Certain hollow glazing units, selected by way of example, will now be described with reference to the accompanying diagrammatic drawings comprising FIGS. 1 and 2 which are cross-sectional views of parts of two different units.

In the unit shown in FIG. 1 two glass sheets 1 and 2 are connected in spaced relationship by marginal spacing means 3. In this embodiment this spacer means comprises a lead strip 4 which forms an endless spacer web between the margins of the glass sheets. The glass sheets are connected to the spacer strip by solder beads such as beads 5, 6, applied between the spacer strip and metallising coatings 7,8 on the margins of the glass sheets. Before soldering the spacer strip 4 to the metallising coating 8 on sheet 2 a series of L-shaped components such as 9, connected to a foil frame, are soldered to that coating by their base flanges. The components 9, which are made of brass, are distributed in spaced relationship around the interior of the unit and in such positions that their upstanding limbs 10 will be located to the inside of the lead spacer strip 4.

The upstanding limbs of the components 9 have been connected by solder spots such as 11, 12 to a foil frame formed by two endless tubular-section frame components 13,14 between which a plastics foil 15 has been glued. The foil has been heat-shrunk after being secured in the frame. The tubes forming the frames 13,14 have holes such as 16 in their inner walls and can be filled with dessicant.

Figure 2:
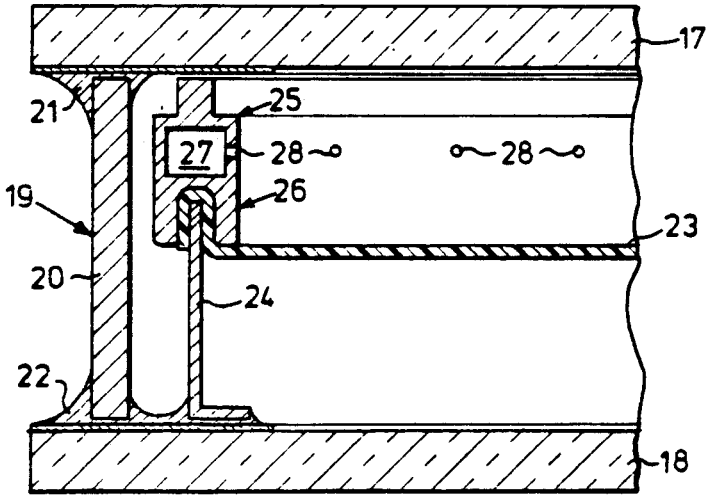
FIG. 2 is a cutaway edge view of an embodiment of the invention showing the plastic foil held by a lead ribbon having an inwardly folded bottom flange soldered to metallized coatings at the edges of the glass sheets, wherein the foil is held in place by a clip in the form of an opposing strip.

In the unit shown in FIG. 2, glass sheets 17,18 are held in spaced relationship by spacer means 19 constituted by a lead strip 20 which forms a spacer web between the margins of such sheets. This lead strip is soldered to metallising coatings on the glass sheets by solder beads 21,22. In the unit according to FIG. 2, the plastics foil 23 is held within the unit by a lead ribbon 24 having an inwardly folded integral bottom flange which is soldered to the metallising coating on the glass sheet 18. The lead ribbon 24 follows an endless course along the periphery of the area across which the foil is to be stretched.

The foil 23 is placed in position with a margin thereof overlapping the top of the foil supporting ribbon 24 and this margin is secured to the ribbon by a lead clip 25 in the form of a strip which extends along the course of the ribbon 24. The bottom portion 26 of the strip 25 is shaped to form a jaw which is pushed over the margin of the foil and onto the lead ribbon 24. In a subsequent operation, the foil is heat-shrunk into a taut wrinkle-free condition. This heat-shrinking operation can be performed after completion of the panel assembly or before the glass sheet 17 is soldered to the spacer strip 20.

The lead clip 25 has a longitudinal passageway 27 therein, in which dessicant can be accommodated, and in a wall of such passageway there are holes such as 28 via which the interior of the passageway is in communication with the interior space of the glazing unit.

In other constructions of unit (not shown) according to the invention the spacing means 3 or 19 as the case may be is formed by a channel section metal strip. The bottom wall of the channel forms a spacing web like the strip 4 or 20 and the side walls of the channel are soldered to the vitreous sheets.

I claim:

1. A hollow glazing unit comprising vitreous sheets having metallized margins held in spaced relationship by marginal spacing means, wherein a plastic foil is held taut between and in spaced relationship to said vitreous sheets by foil holding means located between said vitreous sheets, said spacing means comprises one or more metal strips forming a spacing web which is located outwardly of the periphery of said foil, said metal strips are connected to the vitreous sheets at their margins by soldered joints and said foil holding means comprises one or more components distinct from the spacing web, whereby the spacing web is capable of being angularly deflected without moving said foil holding means.

2. A glazing unit according to claim 1, wherein the plastic foil is resiliently supported within the unit by the foil holding means comprising one or more metal supporting components secured to one said vitreous sheet.

3. A glazing unit according to claim 2, wherein at least one vitreous sheet has a metallized coating on its margin and said metal supporting components and said metal spacing web are both soldered to the metallized coating.

4. A glazing unit according to claim 2, wherein the foil holding means comprises a metal supporting component of an L-profile which provides a base flange which is soldered to said one vitreous sheet and a limb upstanding from that vitreous sheet, and the foil is connected to that limb.

5. A glazing unit according to claim 2, wherein said foil holding means comprises one or more metal supporting components which provides a continuous attachment limb to which the margin of said foil is connected.

6. A glazing unit according to claim 2, wherein said foil is connected to said supporting components by clip means.

7. A glazing unit according to claim 6, wherein said clip means holds dessicant which is exposed to the interior space of the unit.

8. A glazing unit according to claim 2, wherein the foil is held in stretched condition in a frame, and this frame is connected to and resiliently supported in the unit by one or more of said metal supporting components.

9. A glazing unit according to claim 8, wherein said frame is connected to said supporting component by solder.

10. A glazing unit according to claim 8, wherein said frame comprises a pair of component frames which are bonded together with a margin of the foil between them.

11. A glazing unit according to claim 8, wherein said frame holds dessicant which is exposed to the interior space of the unit.

12. A glazing unit according to claim 1, wherein the spacing means consists solely of a spacing web disposed normmally to the vitreous sheets.

13. A glazing unit according to claim 1, wherein the spacing means comprises at least one metal strip which is channel form, the opposed side of the channel being soldered to said vitreous sheets, and the bottom wall of the channel forming said spacing web.

* * * * *